US005692470A

United States Patent [19]

Sattler et al.

[11] Patent Number: 5,692,470

[45] Date of Patent: Dec. 2, 1997

[54] PLASTIC THROTTLE BODY

[75] Inventors: Eric R. Sattler; Joel S. Myers, both of Southgate, Mich.

[73] Assignee: BASF Corporation, Mount Olive, N.J.

[21] Appl. No.: 672,829

[22] Filed: Jun. 28, 1996

[51] Int. Cl.[6] ..... F02D 9/10

[52] U.S. Cl. ..... 123/337; 251/300

[58] Field of Search ..... 123/337; 251/299, 251/300

[56] References Cited

U.S. PATENT DOCUMENTS

| | | | |
|---|---|---|---|
| 1,587,206 | 6/1926 | Williams | 137/493 |
| 1,610,430 | 12/1926 | Demarest | 251/176 |
| 2,016,678 | 10/1935 | Loomis | 222/512 |
| 2,742,324 | 4/1956 | Kerensky | 239/467 |
| 3,348,738 | 10/1967 | Hertlein | 222/88 |
| 3,380,475 | 4/1968 | Armstrong | 251/301 X |
| 3,559,947 | 2/1971 | Sette | 251/147 |
| 3,916,949 | 11/1975 | Armstrong | 137/869 X |
| 3,998,426 | 12/1976 | Isbester | 251/147 |
| 4,112,901 | 9/1978 | Chapin et al. | 123/337 X |
| 4,116,185 | 9/1978 | Mayer et al. | 123/337 |
| 4,306,828 | 12/1981 | Legille et al. | 414/199 |
| 5,048,566 | 9/1991 | Cole et al. | 137/625.4 |

*Primary Examiner*—Tony M. Argenbright
*Attorney, Agent, or Firm*—Ryan W. Massey; Mary E. Golota

[57] ABSTRACT

A plastic throttle body valve including a valve body having an interior passage way connecting an inlet and an outlet of the valve body. The valve body includes an arcuate surface through which the inlet is provided, and a closure member pivotally attached to the valve body for selectively opening and closing the inlet. The valve has the advantage that there is no obstruction in the air stream when the valve is wide open.

6 Claims, 4 Drawing Sheets

PLASTIC THROTTLE BODY

FIELD OF THE INVENTION

The present invention relates to a throttle body valve structure employed to control or meter the flow of air into, for example, a manifold/carburetor arrangement furnishing air to a carburetor designed to combine said air with a suitable fuel and deliver same to an internal combustion engine.

BACKGROUND AND SUMMARY OF THE INVENTION

Traditionally, throttle body valve structures have utilized an internal circular butterfly type valving arrangement for increasing or decreasing the flow of air to a manifold/carburetor arrangement. Controlling the precise amount of air and fuel to the manifold/carburetor is important to the fuel efficiency of an engine. In a fuel injection system of an internal combustion engine, the incoming air is regulated by the throttle body valve which is connected by a linkage to the accelerator pedal. As the accelerator pedal is depressed, the valve is opened allowing air to enter the intake.

Throttle body valve assemblies are traditionally fabricated of metal due to the requirements for strength, durability, dimensional tolerance, machinability, and other advantages inherent in the use of metal. A perceived drawback, however, is that the use of fabricated metals necessarily affect the weight of the overall assembly.

Further, with regard to conventional butterfly valving arrangements, such valving arrangements generally necessitate internal valving components utilizing mounting pins and springs for operation of the butterfly member. These components can become fouled and damaged due to the vulnerable, internal positioning of the components.

Accordingly, it is desirable in the art of fuel intake systems to provide a lightweight, throttle body assembly capable of improved operation in the control of the air flow to the manifold and/or the carburetor.

It is also desirable in the art of valves to provide a valve with an unobstructed internal throat.

It is further desirable to provide a valve capable of improved metering of the air or fluid passing therethrough.

It is further desirable to provide an all-plastic throttle body valve in order to obtain a reduction in weight in comparison with conventional metal throttle body valve assemblies.

Converting a throttle body valve from metal to plastic presents a possible problem due to the dimensioning required in the throat bore to ensure a closed throttle. Due to the variability of the injection molding process, as well as material sensitivity (to the environment), a direct material exchange is not feasible. Thus, in order to produce a plastic throttle body valve that functions well, an alternative design that is less sensitive to molding operations and the environment is provided.

The throttle body valve according to the present invention includes a valve body including an interior passageway connecting an inlet and an outlet of the valve body. The valve body includes an arcuate sliding surface through which the inlet is provided, and a closure member pivotally attached to the valve body for selectively opening and closing the inlet. The present invention is advantageous in that there is no obstruction in the air stream when the throttle body valve is wide open.

Further applicability of the scope of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings wherein.

DETAILED DESCRIPTION OF THE PREFERRED EMBODIMENTS

Figure 1:
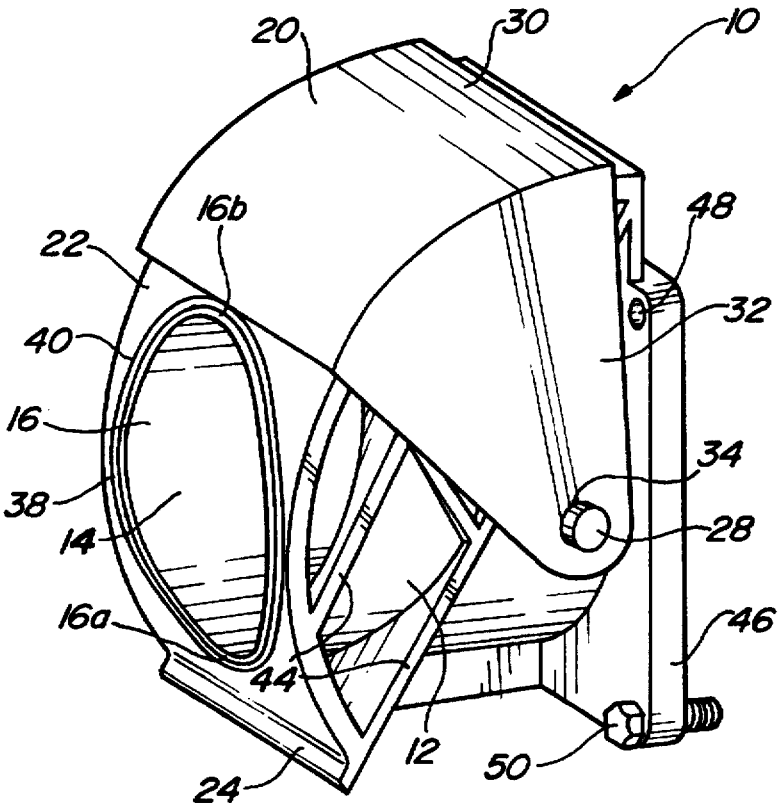
FIG. 1 is a perspective view of a throttle body valve according to the present invention, wherein the throttle body valve is shown in a fully opened position.
Figure 2:
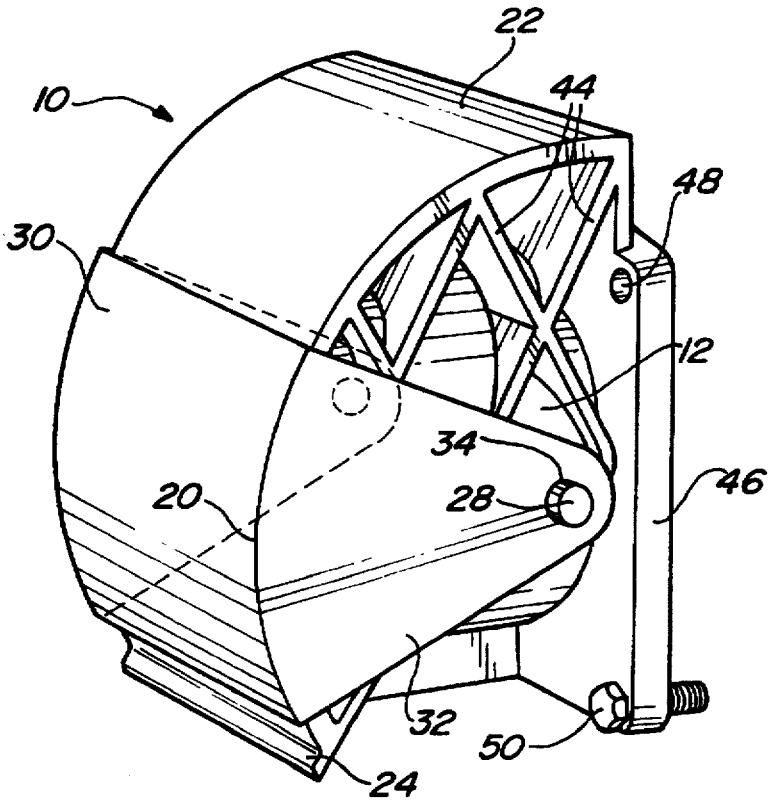
FIG. 2 is a perspective view of the throttle body valve according to the present invention, wherein the throttle body valve is in a fully closed position.
Figure 3:
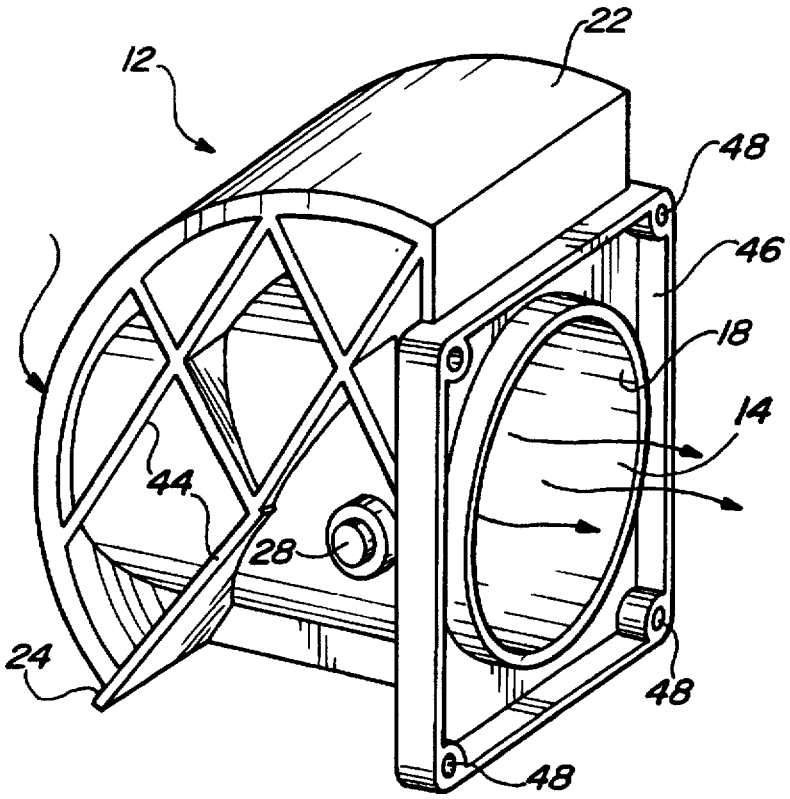
FIG. 3 is a perspective view of a valve body for use in a throttle body valve assembly according to the present invention.

With reference to FIGS. 1–3, a throttle body valve assembly 10 will be described according to a first embodiment of the present invention. Valve assembly 10 includes a valve body 12 including an interior passageway 14 connecting an inlet 16 and an outlet 18, as shown in FIG. 3. An arcuate closure member 20 is pivotally attached to valve body 12 and is provided for selectively covering air inlet 16 for increasing or decreasing air flow through internal passage way 14. Valve body 12 is provided with an exterior arcuate sliding surface 22 against which closure member 20 is in sliding engagement. Arcuate surface 22 is provided with a stop surface or flange 24 adjacent to a first edge **16*a* of air inlet 16. Arcuate surface 22 extends from stop surface 24 to a position beyond a second edge 16*b* of air inlet 16, such that arcuate surface 22 is generally in sliding contact with closure member 20 when closure member 20 is in its fully open position, as shown in FIG. 1. Thus, arcuate surface 22 preferably is in direct contact with the arcuate closure member 20 during a full range of movement from a fully closed position, as shown in FIG. 2, to a fully open position, as shown in FIG. 1. Arcuate surface 22** can also be provided with a stop surface for stopping the movement of the closure member in the fully open position.

Closure member 20 which is pivotally mounted to valve body 12 by pivot bosses 28 extending from opposite sides of valve body 12 is provided with an arcuate sealing portion 30 and first and second arm portions 32 extending generally transversely therefrom. The arms 32 are provided with pivot openings 34 which receive the pivot bosses 28 thereby allowing for pivotal movement to selectively open and close the inlet 16. The curvature of arcuate sealing portion 30 generally corresponds with the curvature of arcuate surface 22 to assist in selectively sealing the inlet.

A seal groove 38 is provided about the periphery of air inlet 16. A circular seal 40 is generally provided in seal groove 38. The seal 40 is preferably formed from a material such as polytetrafluoroethylene, graphite, or a lubricant impregnated engineering material, for example so that the seal does not unduly restrict the desired movement of the closure member. Seal 40 is particularly effective for sealing air leaks between the arcuate sealing portion 30 and arcuate surface 22. Seal 40 also allows the valve assembly 10 to be manufactured with less restrictive molding tolerances.

Arcuate surface 22 preferably includes reinforcing ribs 44 which provide structural strength to arcuate surface 22 and valve body 12. Valve body 12 is provided with a flange 46 which facilitates fastening valve assembly 10 to the desired surface such as a manifold or carburetor for example. Flange 46 is provided with a plurality of bolt holes 48 for receiving bolts 50 for securely fastening valve assembly 10 to a manifold or carburetor.

To activate the valve assembly 10, a cable or motor generally acting through another mechanism, rotates closure member 20 about arcuate surface 22 to cover air inlet 16 as desired.

The valve body 12 and closure member 20 are preferably made from an engineering plastic material having suitable performance properties such as desirable heat stability and dimensional stability. Illustrative materials are nylon (polyamide), a polybutylene terephthalate (PBT) or a PBT and acrylonitrile styrene acrylate (ASA) blend, ABS polymer (acrylonitrile-butadiene-styrene), and polycarbonate. Such materials may also be reinforced with glass and/or mineral fibers or particles. Especially preferred materials are ULTRAMID ® A3HG7 BIk Q17 20560 nylon, ULTRAMID ® A3WG7 BIk 23210 nylon, ULTRAMID ® B3WG7 BIk 564 BGVW nylon and ULTRADUR ® S 4090 G6 polybutylene terephthalate, commercially from BASF Corporation of Wyandotte, Mich.

Figure 4:
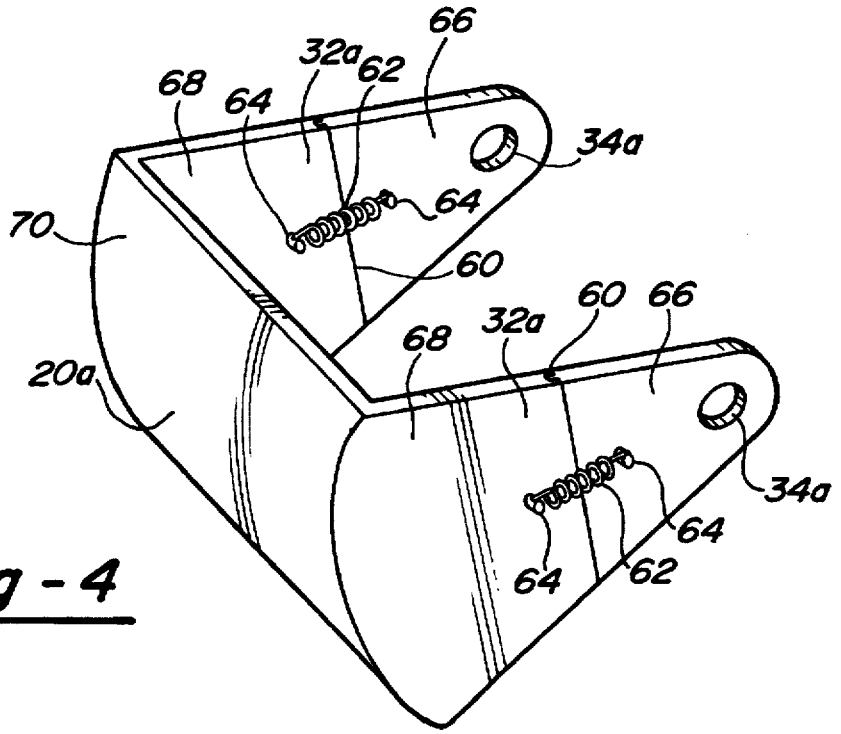
FIG. 4 is a perspective view of an arcuate closure member according to a second embodiment of the present invention.

Referring to FIG. 4, a second embodiment of the present invention is provided with an expansion joint 60 in each of the arms **32*a* of closure member 20*a*. A pair of springs 62 are provided on each arm 32*a* and are attached to the fastening members 64. Expansion joint 60 divides the arms 32*a* into two segments, namely a first segment 66 which includes a pivot opening 34*a* and a second segment 68 which is connected to arcuate portion 70 of closure member 20*a*, Springs 62 are provided for biasing the second segments 68 of arms 32*a* toward the first segments 66 as well as biasing arcuate portion 70 in a direction toward arcuate surface 22 of valve body 12. The biasing force provided by springs 62 ensures a sealing fit between portion 70 of arcuate closure member 20*a* and arcuate surface 22**.

Figure 5:
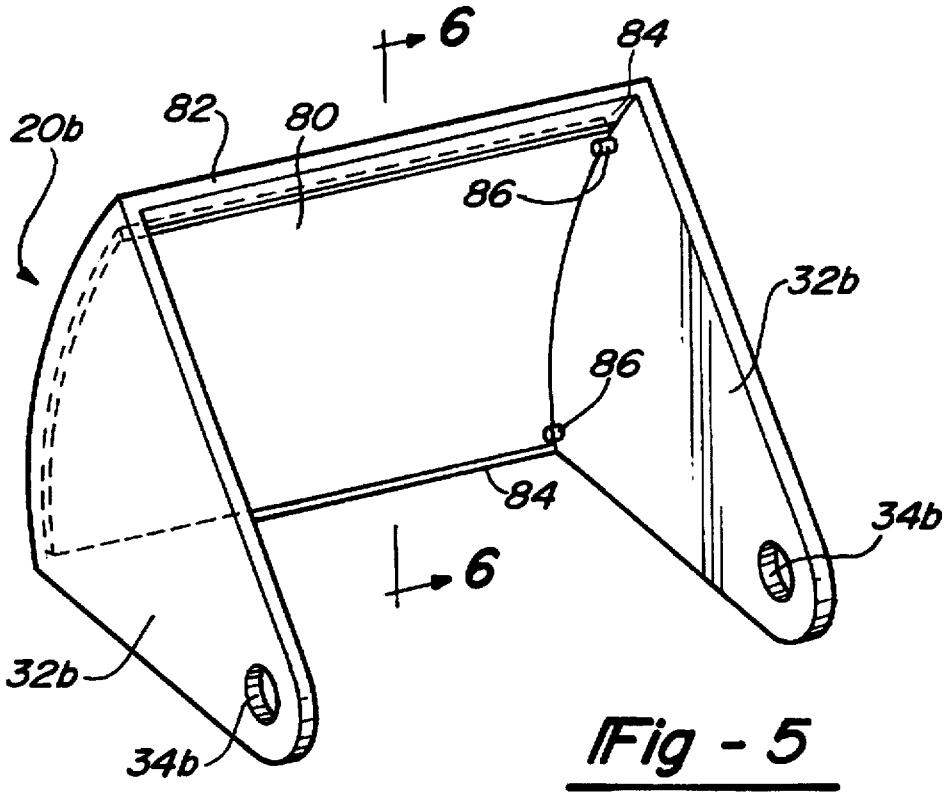
FIG. 5 is a perspective view of an arcuate closure member according to a third embodiment of the present invention wherein a slide plate is provided for obtaining a sealed relationship with the arcuate sliding surface of the valve body.
Figure 6:
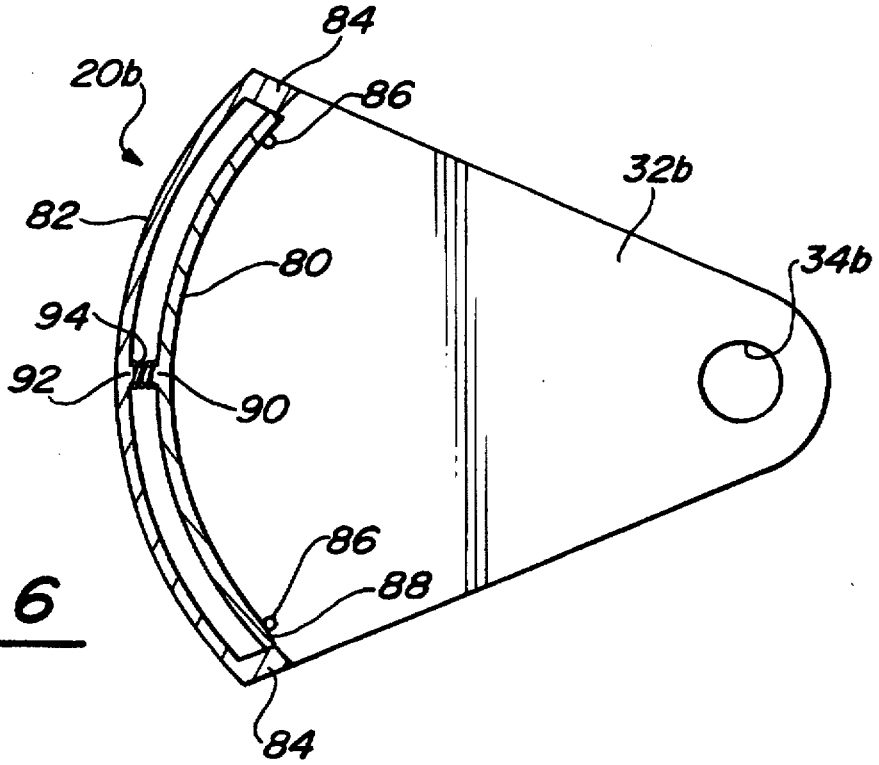
FIG. 6 is a cross-sectional view of the arcuate closure member shown in FIG. 5, illustrating a spring for biasing the slide plate toward the arcuate sliding surface of the valve body.

A third embodiment of the arcuate closure member **20*b* is shown in FIGS. 5 and 6. Closure member 20*b* is provided with an arcuate slide plate 80 which provides a sealing portion, disposed between arms 32*b* and radially inward from arcuate portion 82 which is connected to arms 32*b*. A retaining flange 84 is provided along an edge of arcuate portion 82 in order to maintain slide plate 80 in a proper position with respect to arcuate portion 82. A plurality of retaining pins 86 are provided for supporting slide plate 80 in a radially inward direction. (Alternatively, slide plate 80 could be integrally formed with pins extending laterally therefrom which are received in corresponding grooves in arms 32*b*.) Slide plate 80 is provided with a beveled surface 88 along at least one edge thereof to facilitate a sliding relationship between slide plate 80 and circular seal 40. Furthermore, slide plate 80 is provided with a spring seat 90 and arcuate portion 82 is provided with a spring seat 92 for supporting a spring 94 therebetween. Spring 94 biases slide plate 80 in a radially inward direction so as to provide a sealing contact between slide plate 80 and arcuate surface 22 of valve body 12. It is recognized that springs other than the spring 94 shown in FIG. 6 could be used for biasing slide plate 80 in the radially inward direction. Furthermore, a plurality of springs may be desirable for providing a proper biasing force against slide plate 80**.

Figure 7:
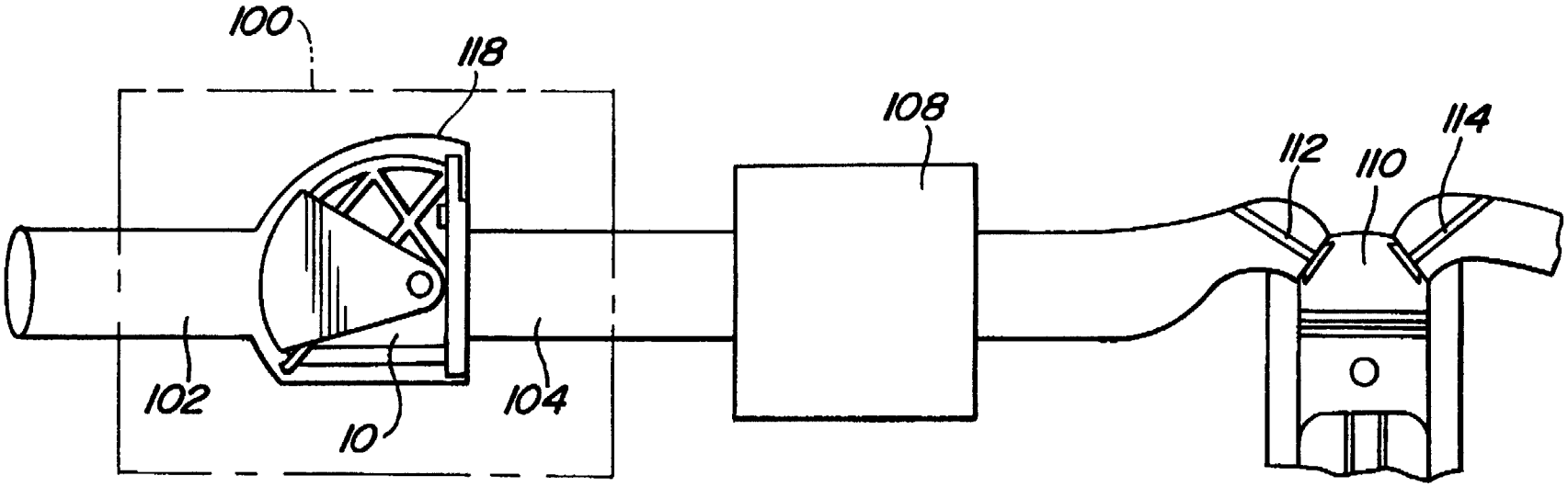
FIG. 7 is a schematic view of an air induction system having a plastic throttle body valve in combination with a fuel introduction apparatus for use with an internal combustion engine.

With reference to FIG. 7, a first embodiment of the valve assembly 10 according to the present invention is illustrated in an air/fuel introduction system for use with an internal combustion engine. It should be noted however that valve assembly 10 is provided for purposes of illustration only since other assemblies provided herein are also applicable.

The air/fuel introduction system generally includes an air induction system 100 which is provided with air passages 102, 104, respectively, leading to and extending from valve assembly 10. A fuel introduction apparatus 108 is provided for introducing fuel to the air passing through air induction system 100. The mixed air and fuel are then introduced to engine cylinders 110 via intake valve 112. The combusted air is exhausted through exhaust valve 114. It should be noted that the valve assembly 10 can be utilized with any known fuel introduction apparatus. For example, and without intending to be limiting, fuel introduction apparatus generally include carburetors, fuel injectors, and throttle body fuel injectors which are all well known in the art. The valve assembly 10 is provided within a housing 118 which covers valve assembly 10 and provides a sealed connection with air passages 102, 104.

The location of fuel introduction apparatus 108 will vary depending upon the type of apparatus used. For example, for a throttle body fuel injection system, the injectors would generally be located adjacent to the valve assembly 10. With a fuel injection system, the injector would typically be connected directly to engine cylinders 110 for introducing fuel directly therein. Finally, a carburetor would be located in between valve assembly 10 and engine cylinders 110. Typically, an air intake manifold is provided for distributing air or an air fuel mixture to the individual cylinders of an engine.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An air/fuel introduction system for use with an internal combustion engine, comprising:

an air induction system having an inlet passage and a valve assembly disposed in said inlet passage, said valve assembly including a plastic valve body including an interior passageway connecting an inlet and an outlet of said valve body, said valve body having an arcuate surface through which said inlet is provided, and a plastic closure member pivotally attached to said valve body, said closure member having a sealing portion disposed adjacent to said arcuate surface of said valve body and selectively movable between a closed position for generally covering said inlet and an open position wherein said inlet is generally uncovered by said sealing portion; and a fuel introduction apparatus for introducing fuel to air which passes through said valve assembly.

2. The air/fuel introduction system according to claim 1, further comprising biasing means for biasing said sealing portion against said arcuate surface of said valve body.

3. The air/fuel introduction system according to claim 2, wherein said closure member is provided with a pair of arms having first and second segments defining an expansion joint therebetween, wherein said biasing means is provided for biasing said first and second segments together.

4. The air/fuel introduction system according to claim 2, wherein said sealing portion includes a slide plate slidably supported by said closure member, said slide plate being biased against said arcuate surface of said valve body by said biasing means.

5. The air/fuel introduction system according to claim 4, wherein said closure member is provided with a pair of arms for pivotally mounting said closure member to said valve body and said slide plate is biased against said arcuate surface by a spring disposed between said slide plate and plate connecting said pair of arms.

6. The air/fuel introduction system according to claim 2, wherein said sealing portion is arcuate in shape.

* * * * *